United States Patent [19]

Stoakes

[11] 4,453,355

[45] Jun. 12, 1984

[54] CURTAIN WALL CONSTRUCTIONS

[76] Inventor: Richard L. Stoakes, "Clouds", Northdown Rd., Woldingham, Surrey, England

[21] Appl. No.: 402,244

[22] Filed: Jul. 27, 1982

[30] Foreign Application Priority Data

Jul. 28, 1981 [GB] United Kingdom ..... 8123196

[51] Int. Cl.[3] ..... E04H 1/00; E04C 3/30

[52] U.S. Cl. ..... 52/235; 52/573; 52/731

[58] Field of Search ..... 52/235, 236.3, 236.7, 52/398, 399, 731

[56] References Cited

U.S. PATENT DOCUMENTS

| | | | |
|---|---|---|---|
| 3,509,672 | 5/1970 | Brooks | 52/235 |
| 3,522,684 | 8/1970 | Grossman | 52/235 |
| 3,553,918 | 1/1971 | Dauson | 52/235 |
| 3,736,709 | 6/1973 | Koch et al. | 52/236.7 |
| 3,893,272 | 7/1975 | Plom | 52/235 |
| 3,940,897 | 3/1976 | Stoakes | 52/235 |
| 3,968,608 | 7/1976 | Swango | 52/398 |
| 4,194,333 | 3/1980 | Paton et al. | 52/235 |
| 4,266,387 | 5/1981 | Karlsson | 52/731 |

FOREIGN PATENT DOCUMENTS

| | | | |
|---|---|---|---|
| 2752235 | 6/1978 | Fed. Rep. of Germany | 52/398 |

*Primary Examiner*—John E. Murtagh
*Assistant Examiner*—Andrew Joseph Rudy
*Attorney, Agent, or Firm*—Hopgood, Calimafde, Kalil, Blaustein & Judlowe

[57] ABSTRACT

A curtain wall structure has a framework comprising mullions that are each built up from a plurality of elongate members disposed end to end with expansion gaps between the members, and interconnecting means bridging said gaps transmitting bending loads between successive mullion members. Transoms of the framework at the expansion gaps comprise interengaging upper and lower elongate elements relatively displaceable to each other both vertically and horizontally in the plane of the framework. Resilient sealing members extend externally between the upper and lower transom elements at the expansion gaps. The framework is secured to a load-bearing structure by attachment members engaging both the mullion members and their interconnecting means at positions spaced from the expansion gaps.

8 Claims, 4 Drawing Figures

CURTAIN WALL CONSTRUCTIONS

BACKGROUND OF THE INVENTION

This invention relates to curtain walling components and constructions.

A common form of multi-storey building construction employs a main, load-bearing structure, e.g. of reinforced concrete, comprising floor slabs at each storey, with the outer walls of the construction formed only by relatively lightly loaded curtain walls supported from the load-bearing structure, in particular the outer edges of the floor slabs. The curtain walls are typically metal-framed structures of mullions (vertical frame members) and transoms (horizontal frame members) with an infill of panels or glazing of various types, these structures being arranged to be weathertight and to resist wind loads but their weight being supported by the load-bearing structure.

From such causes as the aging of a building and the loads imposed on it, and changes of temperature, various movements take place and the curtain walls must be able to accommodate these while maintaining their integrity. Thus, aging of a reinforced concrete building can result in a shrinkage or creep phenomenon known as "slump" in which there is a small but steady downwards flow of the main cast structure tending to produce a small but measurable shortening: it may be required to allow a shortening of 1 to 1.5 mm between successive floors of the building for this. Then there are live load deflections on the floor slabs, which can vary between different designs and uses but typically it might be necessary to allow for a maximum deflection of about 6 mm at the edge of each floor slab. In addition, there are temperature effects, partly due to the differences between interior and exterior temperatures and also due to changes of temperature in the different materials used in the construction, and for these effects a difference of about 3 mm per floor must be allowed between the curtain walling and the load bearing structure. Through the combination of these different causes it may be necessary to allow for a maximum relative movement of over 10 mm between the curtain wall frame structure and the floor slabs over the span of one storey.

Conventionally, relative vertical movements have been accommodated by having a series of short mullion members each extending between a successive pair of floor slabs and attaching the ends of each said mullion member to the two floor slabs so that there is a gap between its adjoining mullion members above and below it, one of the end attachments also permitting relative vertical movement between the mullion member and the floor slab. This results in the expansion gap being located intermediate the height of the infill members that will extend between the top of the upstand rising from the edge of the floor slab and the level of the ceiling below the floor slab. the gaps between the relatively short mullion members allow relative movement between them. The infill is undersized relative to the nominal vertical spacings of the transoms above and below the gaps so that it does not hinder the contraction of the gap. This results in the bottom edge of the infill panels resting on each transom below it and there being a substantial clearance between the top edge of the infill and the transom above it.

This however is unsatisfactory. In the first place, repeated changes of the gap dimensions as slight vertical movements occur can result in the displacement of the seals around the infill, so that in the course of time the sealing effect is less than satisfactory and rain can penetrate the curtain wall. Also, the maixmum gap that can be allowed at the top of the infill members is limited, because an excessive gap would make sealing more difficult and can even affect the security of retention of the infill, especially as some side-to-side clearance might also be required to accommodate the usually smaller horizontal movements. Since the possible maximum vertical gap is limited, it is essential to introduce the expansion breaks between each successive pair of floor slabs, and even then it may be difficult to provide a satisfactory result if the dimensions and/or loading of the construction requires a large expansion gap—in particular with larger temperature differentials and floor spacings or with greater live load deflections, as might be required in earthquake zones.

It is known from British Pat. No. 1,531,593 to arrange an array of glazed metal frames to form a curtain wall of a building. Each glazed frame has a bar running across it intermediate its height to provide for its connection directly to the load-bearing structure of the building to support the frame, independently of the other frames of the array. Extreme ends of each bar have further connections with the load-bearing structure that accommodate vertical sliding movements, these being intended to hold the respective frame against wind forces. Finally, there are tenon pin connections between vertically successive frames that fix the frames together except for vertical sliding movements.

It will be noted that this construction provides only for vertical displacements. However, this is not sufficient to accommodate transient loads and longer term movements of the building as a whole. In particular, it can be expected that both transient loads and long-term movements of the building structure will occur horizontally in the plane of the curtain wall as well as vertically. One source of such movements may be the differential thermal expansion that occurs in large size structures. The construction of British Pat. No. 1,531,593 has no means of permitting horizontal movement between the frames of a vertical series, and the unrelieved horizontal forces can have the effect of preventing intended vertical displacements, because they will tend to place side loads on the tenon pin connections which will at least give an increased frictional resistance to sliding and can also deform the pins so that they are no longer able to slide in their receiving holes. These pins will receive further loads from wind forces, unless care is taken to support each frame at the middle of its height to prevent the wind force on the area of the frame producing a resultant turning moment about the bar end connections, and the avoidance of this condition is a considerable restraint on the design of the structure.

BRIEF STATEMENT OF THE INVENTION

According to the present invention, there is provided a curtain wall for a multi-storey construction having a load-bearing structure comprising a series of vertically spaced members to which the curtain wall is secured, said curtain wall comprising a framework of mullions and transoms, each mullion being formed by a plurality of elongate members secured to respective vertically spaced members of said structure and disposed end to end with a gap between the facing ends of the or each adjoining pair of members of the mullion at the level of a line of transom members to permit relative longitudinal movement between said members, the or each said gap being disposed at the level of a transom that comprises upper and lower elements attached to the respective adjoining mullion members to be relatively movable therewith towards and away from each other, interengagement means between said transom elements permitting relative movement longitudinally of said elements as well as said movement towards and away from each other, and external sealing means extending between said relatively movable transom elements.

Conveniently, said gap or gaps are located at some distance from the points of securing of the mullion members to the structure and interconnecting means are provided that are adapted to transmit bending loads between the separate members. Said interconnecting means are preferably elongate members slidably insertable into each adjoining pair of mullion members to be fixedly secured to one but to remain slidable with respect to the other. It can be arranged that the elongate interconnecting members are secured longitudinally by the same means that secure one of their associated pair of mullion members to the load-bearing structure.

Preferably, the external sealing means between the upper and lower transom elements comprise an elastomeric gasket having upper and lower margins secured to the respective elements and an intermediate portion between said margins that can flex with the relative longitudinal movements of the adjoining ends of the associated mullions.

It is also preferred for the upper and lower transom elements to have slidable interengagement means that locate them together against forces acting out of the plane of the surrounding region of the curtain wall. In their longitudinal direction however, the transom elements are preferably displaceably mounted at least at one end to accommodate the smaller relative horizontal movements that can occur in this direction between adjacent parallel mullions.

DETAILED DESCRIPTION

Figure 1:
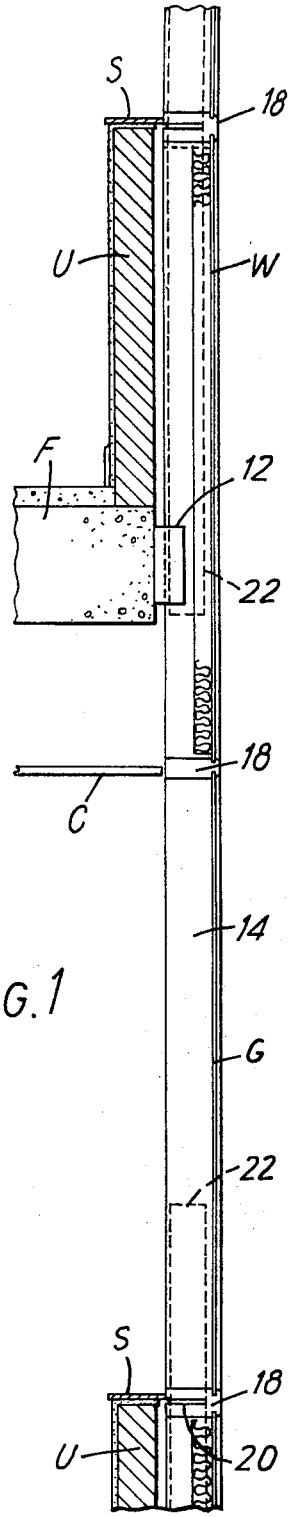
Figure 2:
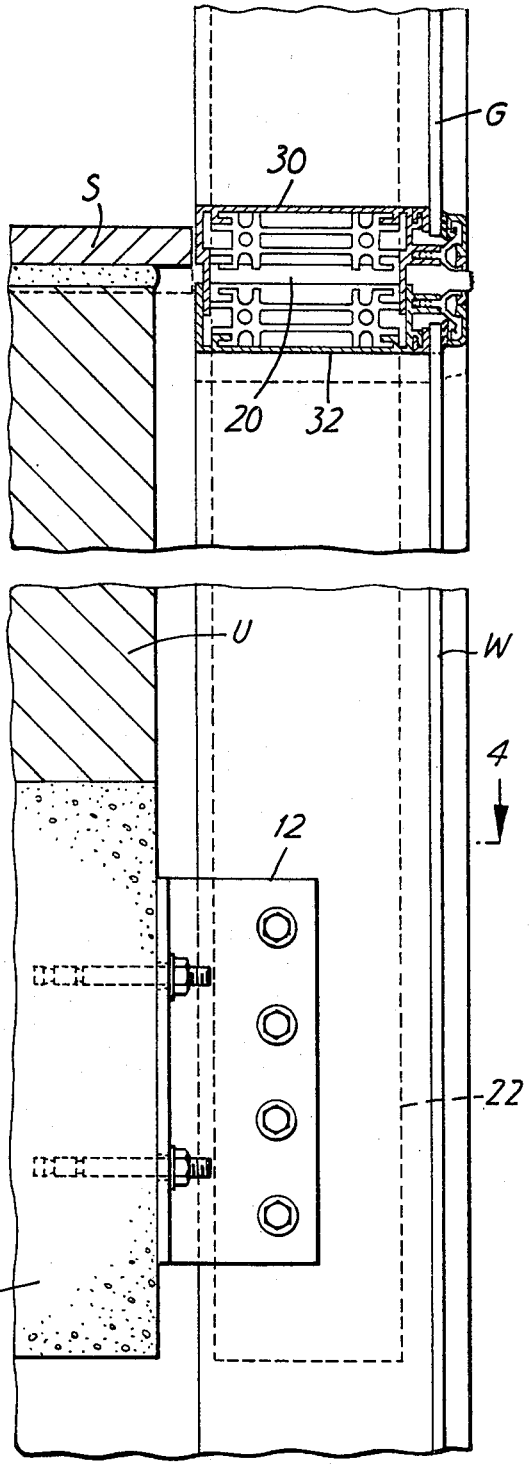
Figure 3:
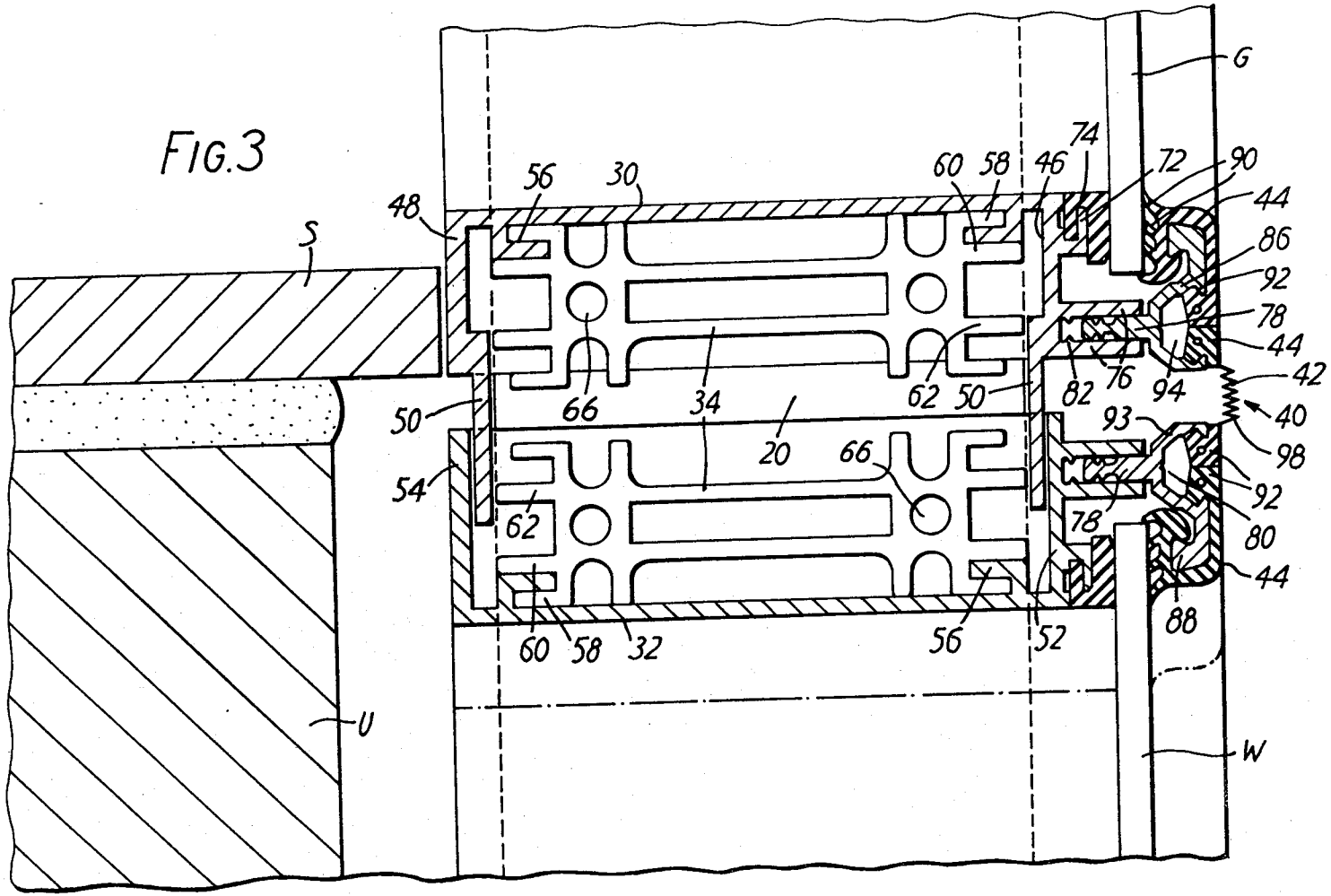
Figure 4:
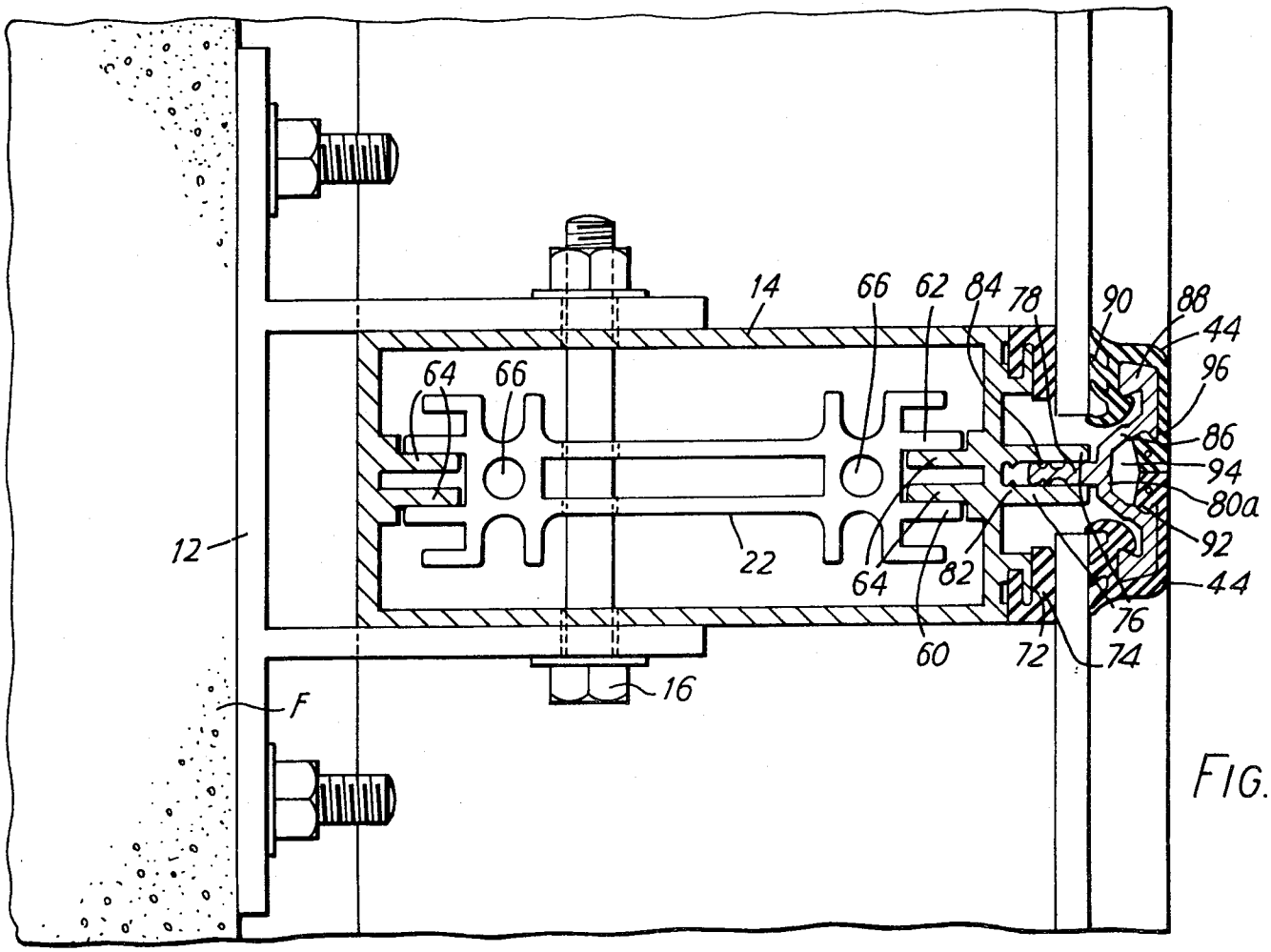

By way of example, an embodiment of the invention will now be described in more detail with reference to the accompanying drawings, in which:

FIG. 1 illustrates in outline a vertical section over one floor span on a building construction having a curtain wall according to the invention, FIG. 2 is another vertical section to a larger scale showing more detail of the construction over the height of a floor slab and its upstand, FIG. 3 is a more detailed view of the expansion joint between mullion members that can be seen in FIG. 2, and FIG. 4 is a horizontal section through a mullion member on the line 4—4 in FIG. 2 and on the scale of FIG. 3.

In the drawings, the load-bearing structure of the construction is indicated only fragmentarily by the edge regions of reinforced concrete floor slabs F. It will be understood that this structure can be entirely conventional and will normally have a multi-storey form. Also illustrated are the concrete upstands or make-up walls U, normally required for fire-resistance, rising from the edges of the floor slabs, and one of the suspended ceilings C that will be supported from their overlying floor slabs to leave service spaces between the slabs and the ceilings.

The curtain wall is mounted on the outer edges of the load-bearing structure by angle-form fixing cleats 12 to which vertical mullion members 14 of the structure are secured by bolts 16. Horizontal transom members 18 extend between laterally adjacent mullion members to define with them a series of rectangular infill spaces. Typically, the transom members 18 are located at the levels of the suspended ceilings C and of sill members S on the top of the upstands, so that between a ceiling and the sill above it wall panels W are used as infill, while a glazing infill G is used between the sills and the ceilings above them. The mullion members 14 are shown terminating at the sill transoms, vertically spaced ends of vertically adjacent mullion members facing each other, whereby an expansion gap 20 is provided between the adjacent mullion members but it will be understood that other arrangements are possible, it only being required that each mullion member should be secured to one floor slab so as to transmit to that slab the gravity load on it, and that the ends of the mullion member should coincide with transom members of the curtain wall structure.

The mullion members are extruded metal hollow-box sections and adjoining members are interconnected by elongate spigots 22 that are a close sliding fit in the members. At one end, each spigot is fixed relative to its mullion member, the bolts 16 of the fixing cleats being used for this, but it remains slidable in the other member. Relative vertical movements can therefore take place between the mullion members to accommodate the load-bearing structure movements and relative thermal expansion effects referred to above, but the elongate form of these closely fitting spigots considerably stiffens the mullion members so that they can resist transverse loads such as wind loads substantially as effectively as a continuous mullion, and if made of a sufficient length they can indeed increase the flexural strength of the mullions.

At the expansion gaps coinciding with the sill transoms, the transom members are composed of upper and lower elements 30,32 attached to the adjacent upper and lower mullion members respectively. For this purpose, shorter spigots 34 are secured to the lateral faces of the mullion members and the transom elements engage these slidably. At the ceilings the transom members are not of divided form and can be provided by the same extruded cross-section as the mullion members, similarly mounted on spigots 34.

It will be clear from the foregoing description that the structure movements mentioned do not affect the vertical dimensions of the infill spaces formed by the mullions and transoms, as all the major displacements take place on joints between these spaces, formed by the interconnected mullion members 14 and transom elements 30,32. In order to maintain weathertightness at these joints, extruded neoprene sealing gaskets 40 bridge the transom elements and are made up of a bellows-like expansion section 42 between separate upper and lower sections 44 that are locked onto the upper and lower transom elements 30,32.

The upper and lower transom elements are interengaged to be located together transverse to the plane of the curtain wall. Each element is of generally channel section with the front and rear flanges 46,48 of the upper elements carrying extensions 50 that fit closely between the front and rear flanges 52, 54 of the lower element. The opposed faces of the webs of the upper and lower elements have a pair of L-shaped spurs 56 that engage the elements slidably with their respective mounting spigots 34. These spigots are of symmetrical cross-section and are of the same extrusion as is used for the mullion spigots. Whereas outer pairs of ribs 58,60 on the spigots locate the L-ribs of the transom elements, inner pairs of ribs 60,62 locate the spigots slidably on pairs of ribs 64 in the inside faces of the front and rear walls of the mullion box section. The apertures 66 in the spigot extrusion are provided for fixing screws (not shown) to secure the transom spigots to the mullion members.

Similar sealing means are attached to the mullions and to the transoms for the curtain wall infill. On each frame member or element there are front spurs 72 on which U-shaped neoprene extrusions 74 fit to seal against the rear edges of the panes or panels. Each member or element also has a pair of parallel front projections 76 for holding the central rear limb 78 of an extruded metal Y-section clamping member 80 (for the transom elements 30,32 of the expansion joint) or 80*a* (for a fixed joint as shown in FIG. 4). Small interlocking ribs 82 and indents 84 co-operate between the projections 76 and the central limb 78 to hold them together after assembly. If required, further security can be provided by screws (not shown) driven through the clamping member from the front on the centreline between the projections 76 so that the screw-thread engages the opposed faces of the projections.

Describing first the fixed joint of FIG. 4, on each of the symmetrically disposed front limbs 86 of a clamping member there is mounted a respective gasket section 44. This section has a series of lips 90 that seal against the front edge of the pane or panel and a front locking element 92 that is seated in the recess 94 between the front limbs 86. The gasket section is initially mounted on the bulbous head 88 of its front limb during assembly, but with its locking element left free. After the clamping member has been secured in place and the sealing lips 90 have been brought firmly against the pane or panel edge, the opposed locking elements 92 are forced into the recess between the limbs to be held compressed against each other and to be locked there by the narrowed neck formed between projections 96 at the front of the recess.

In the case of the expansion joint of FIG. 3 the clamping member 80 section is asymmetrical, one front limb having a bulbous head 88 for attachment of a gasket section 44, but this head being absent from the other limb 93, so that there is a substantial clearance between the adjacent limbs 93 of the two clamping members. The two gasket sections 44 on the heads 88 are locked sealingly against the intermediate section 42 interposed between them. The section 42 also has locking elements 92 that co-operate with the locking elements 92 of the gasket sections 44 on the respective transom elements at opposite sides of the expansion gap, and an intermediate bellows portion 98 that is able to expand and contract freely with the dimensional changes of the gap. The bellows portion 98 is outwardly convex so that it will tend to protrude outwards as the transom elements approach each other, and therefore be less likely to assume a position blocking such movement. Expansion of the joint results in flexure of the portions of the bellows profile between folds with very little stress in the material.

As has been already described, the expansion movements available at the intermediate gasket do not affect the infill panels at all and these will be required to make at the most a small relative displacement in their sealing gaskets for any dimensional changes that occur within each cell of the curtain wall framework, e.g. due to thermal expansion, but are not exposed at all to relative vertical movements between the load-carrying structure and the curtain wall.

Relatively large vertical movements can therefore be easily accommodated and although the example illustrated shows mullion members that span a single floor between expansion gaps, it is possible to employ the invention to provide longer mullion members spanning two floors or more if desired for savings of manufacturing and assembly costs. In each case the mullion members will be fixed to a single floor slab only, but can be attached to any further floor slab within their span in a manner that allows relative vertical movement, e.g. by elongating the holes through which the fixing cleat bolts 16 pass. In such an arrangement, the live load deflections of any such intermediate floor slabs are not transmitted to the mullions, so that if the required expansion gap forms a two-floor span, for example, it will require considerably less than twice the expansion gap required for a one-floor span.

Many modifications are possible within the scope of the invention. For example, the spigots inserted into the mullion members can interconnect more than two coaxial mullion members if this can be done conveniently. Other forms of sealing gasket can be used, although preferably the gaskets will still completely shield the metal framework externally of the infill. Also, whereas the transoms of the illustrated embodiment are relatively short members each extending only between laterally successive mullions, they can alternatively extend through the gaps between mullion members although they must then be arranged to accommodate the interconnecting means bridging the mullion members.

What is claimed is:

1. A curtain wall for a multi-storey construction having a load-bearing structure comprising a series of vertically spaced members to which the curtain wall is secured, said curtain wall comprising a series of upwardly extending mullions and a series of transoms at spaced elevations in the vertical extent of the wall, said mullions and transoms being secured together to form a framework of said wall, each mullion being formed by a plurality of elongate members, means for securing said elongate mullion members to respective vertically spaced members of the structure, each adjoining pair of elongate mullion members having respective ends facing each other, a gap being provided between said facing ends to permit relative longitudinal movement between said adjoining pair of mullion members, each said gap being disposed at the elevation of a transom, and said transom comprising upper and lower elements attached to the respective adjoining mullion members to be relatively movable therewith towards and away from each other, said transom having interengagement means between said elements of the transom permitting relative movement longitudinally of said elements as well as said movement towards and away from each other, and external sealing means extending between said relatively movable transom elements.

2. A curtain wall according to claim 1, wherein said gaps are spaced from said securing means of the mullion members to the structure, and wherein interconnecting means are provided between said mullion members for transmitting bending loads between the separate members.

3. A curtain wall according to claim 2, wherein said interconnecting means are elongate members slidably insertable into each adjoining pair of mullion members to be fixedly secured to one but to remain slidable with respect to the other.

4. A curtain wall according to claim 2, wherein means for securing the mullion members to said load-bearing structure also secure said interconnecting means thereto.

5. A curtain wall according to claim 1, wherein the external sealing means between the upper and lower transom elements comprise a first elastomeric gasket having upper and lower margins secured to said upper and lower transom elements respectively, and an an intermediate portion between said margins that can flex with the relative movements of the transom elements towards and away from each other.

6. A curtain wall according to claim 5, wherein further gaskets are provided on the respective transom elements for providing seals for the edges of the infill means bounded by said transom elements, and said first gasket cooperates sealingly with said further gaskets.

7. A curtain wall according to claim 1, wherein said transom interengagement means act between the upper and lower transom elements to locate said transom elements together in a direction transverse to the plane of the surrounding region of the curtain wall.

8. A curtain wall according to claim 1, wherein the transom elements extend between laterally adjacent mullion members, and wherein displaceable mounting means are provided at least at one end of the transom elements for attachment of the transom elements to the adjacent mullion member in a manner accommodating relative movement between said laterally adjacent mullion members.

* * * * *